US005952770A

United States Patent [19]

Mueller et al.

[11] Patent Number: 5,952,770

[45] Date of Patent: Sep. 14, 1999

[54] SPARK PLUG FOR INTERNAL COMBUSTION ENGINE

[75] Inventors: Roland Mueller, Steinheim; Richard Adamczuk, Leonberg; Werner Herden, Gerlingen; Manfred Vogel, Ditzingen; Walter Benedikt; Andreas Niegel, both of Kornwestheim; Hans-Dieter Herde, Ludwigsburg; Rudolf Pollner, Bamberg; Dietrich Trachte, Leonberg; Bernd Mueller, Korntal-Muenchingen; Dittmar Klett, Pleidelsheim, all of Germany

[73] Assignee: Robert Bosch GmbH, Stuttgart, Germany

[21] Appl. No.: 09/011,843

[22] PCT Filed: May 22, 1997

[86] PCT No.: PCT/DE97/01025

§ 371 Date: Feb. 13, 1998

§ 102(e) Date: Feb. 13, 1998

[87] PCT Pub. No.: WO97/49153

PCT Pub. Date: Dec. 24, 1997

[30] Foreign Application Priority Data

Jun. 15, 1996 [DE] Germany ..... 196 23 989

[51] Int. Cl.[6] ..... H01T 13/20

[52] U.S. Cl. ..... 313/141; 313/136

[58] Field of Search ..... 313/118, 141, 313/135, 136, 138, 140, 139

[56] References Cited

U.S. PATENT DOCUMENTS

| | | | |
|---|---|---|---|
| 4,083,395 | 4/1978 | Matesco | 313/141 |
| 5,017,826 | 5/1991 | Oshima et al. | 313/141 |
| 5,273,474 | 12/1993 | Oshima et al. | 313/141 |

FOREIGN PATENT DOCUMENTS 44 31 143 3/1996 Germany .

OTHER PUBLICATIONS

Patent Abstracts of Japan, vol. 014, No. 002 (E–868), JP 01 251576 A, Oct. 6, 1989.

Patent Abstracts of Japan, vol. 014, No. 524 (E–1003), JP 02 220385 A, Sep. 3, 1990.

*Primary Examiner*—Nimeshkumar D. Patel

*Attorney, Agent, or Firm*—Kenyon & Kenyon

[57] ABSTRACT

A spark plug having a tube-shaped, metal housing, an insulator which is retained by the housing, and an inner conductor arrangement embedded in the insulator, the inner conductor arrangement comprising one connection bolt, one burn-off resistor, one contact pin, and one platinum central electrode, and four ground electrodes, which are bent towards the central electrode and protrude beyond the insulator by the width of their thickness, being secured to the housing, the contact pin being coated and being shortened in its length such that the burn-off resistor is forward-positioned as far as possible towards the spark gap, and the platinum central electrode having a nail shape, whose rear part has a smaller diameter than its front part, which extends out of the insulator.

3 Claims, 2 Drawing Sheets

SPARK PLUG FOR INTERNAL COMBUSTION ENGINE

BACKGROUND OF THE INVENTION

The present invention relates to a spark plug for internal combustion engines.

BACKGROUND INFORMATION

A conventional spark plug is described in German Patent Application No. 44 31 143. It proposes a spark plug which exhibits minimal wear. In the case of the conventional spark plug, a rod-shaped inner conductor is set in a cylindrical metal tube which constitutes the housing, said inner conductor being enclosed in an insulator and having a current-limiting resistor in the electric circuit of the spark plug, said current-limiting resistor being arranged such that it is forward-positioned in the direction of the spark plug's spark gap as close to the spark gap as possible. In addition, in this spark plug, the diameter of the inner conductor is reduced, as compared to conventional spark plugs, as a result of which the capacitance of the spark plug is reduced. In this spark plug, in accordance with German Patent Application No. 44 31 143, the electrode head of the inner conductor is covered with a precious metal coating, and material having good thermal conductivity is used as the electrode head, which also acts as a heat buffer.

SUMMARY OF THE INVENTION

In contrast to a conventional spark plug, a spark plug according to the present invention has the advantage of making available a greater volume that is subject to wear by configuring the electrode in the form of a "nail head." In addition, by reducing the contact pin's diameter and length, and by forward-positioning the burn-off resistor, one can achieve that fewer mechanical stresses caused by different thermal expansion coefficients will occur. By reducing electrode burn-off, nicks in the ceramic can ultimately be substantially avoided. A further advantage lies in the coating of the contact pin, through which means a high corrosion-resistance is achieved. Finally, by configuring the ground electrode in a single or double bend and projecting it beyond the end face of the insulator, the electrical field is so configured that ceramic breakdowns are able to be advantageously prevented.

It is particularly advantageous to dope the platinum electrode. This doping prevents the contact pin from corroding, since the platinum electrode is sintered, gas-tight, into the ceramic. Through the gas-tight bonding of the electrode, the ceramic, and the contact pin using an active solder, the contact pin is also prevented from corroding and from retracting. Ultimately, an electrically conductive ceramic-metal mixture may be substituted for the contact pin, the contact pin likewise being prevented from retracting, and mechanical stresses being avoided as a result of having identical thermal expansion coefficients.

DETAILED DESCRIPTION OF THE INVENTION

Figure 1:
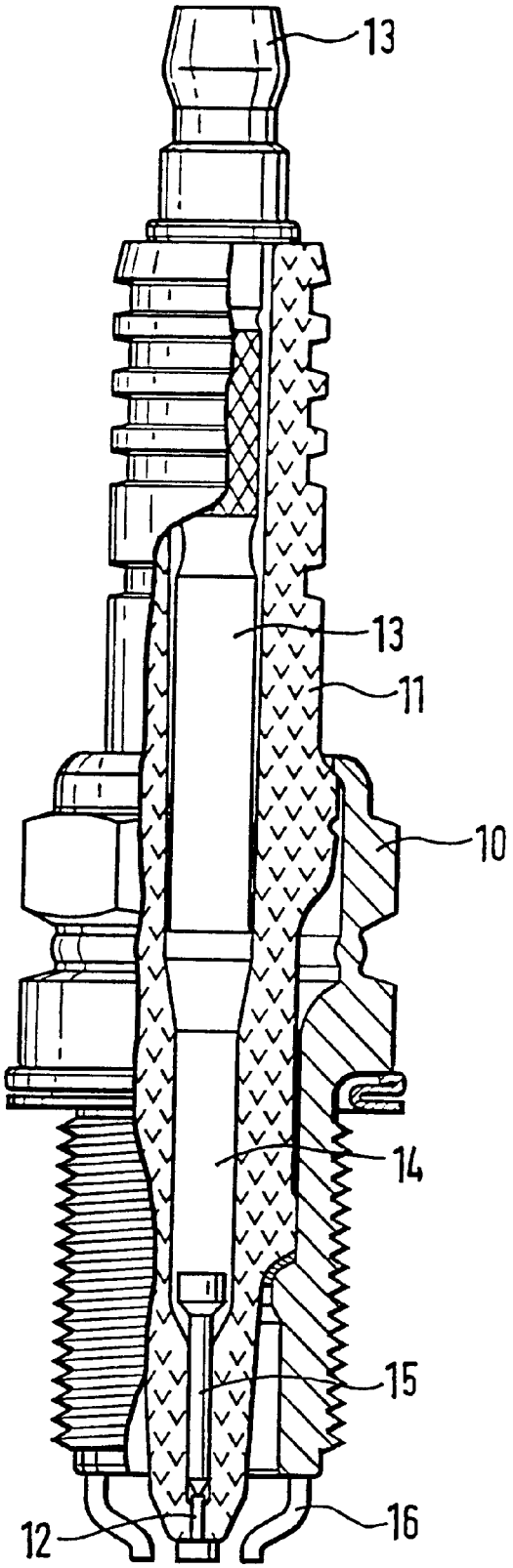
FIG. 1 shows a spark plug according to the present invention.

FIG. 1 schematically shows the interior part of a spark plug in a partial cut-away representation. In this context, an insulator 11 is arranged in a metal, tube-shaped housing 10, the rotationally symmetric axes of housing 10 and insulator 11 being coincident. Embedded in insulator 11 is central electrode 12, as well as the individual components described below for transmitting the voltage from connection bolt 13 to central electrode 12. Inside insulator 11, connection bolt 13 is joined to burn-off resistor 14. Burn-off resistor 14 is connected to contact pin 15, so that the voltage is transmitted over contact pin 15 to central electrode 12. Central electrode 12 is made of platinum and essentially has the shape of a nail. This means that the rear part of platinum central electrode 12 has a significantly smaller diameter than the combustion-chamber-side part of the platinum central electrode, which extends out of insulator 11. Contact pin 15 itself is covered with a corrosion-protection coating, e.g., with nickel or with a nickel-silver alloy. In addition, compared with conventional spark plugs, contact pin 15 is significantly shortened in its length and reduced in its diameter. By shortening contact pin 15, the burn-off resistor is lengthened and is forward-positioned in the direction of the spark gap, which has the advantages that have already been described in German Patent Application No. 44 31 143. Ground electrodes 16 are secured to housing 10 and are bent towards the central electrode. FIG. 1 shows that the ground electrodes are bent twice, provision being made here for four ground electrodes. In this context, the ground electrode secured to the housing is first bent in the direction of the central electrode and is then bent a second time in the axial direction, so that the end face of the ground electrode is facing in the axial direction of the spark plug. In this context, the end face of ground electrode 16 protrudes by a specifiable amount beyond the end face of the insulator. The amount of the protrusion here corresponds roughly to the thickness of a ground electrode.

Figure 2:
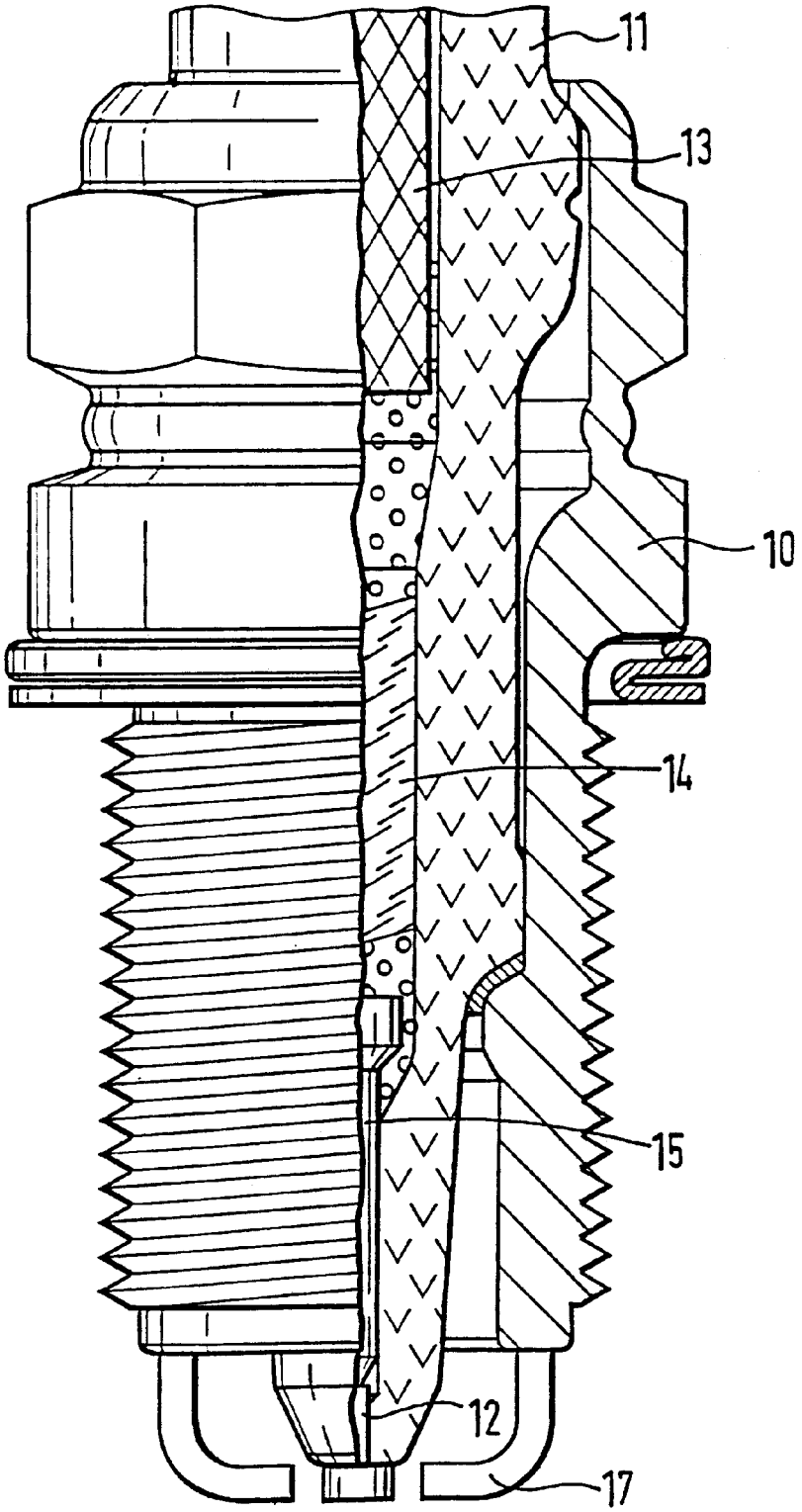
FIG. 2 shows the combustion-chamber-side end of the spark plug having differently positioned ground electrodes, according to the present invention.

FIG. 2 shows the spark plug having essentially the identical design as in FIG. 1. The sole difference from FIG. 1 lies in the positioning of the ground electrodes. In FIG. 2, the ground electrodes are bent once, thus making the end face of the ground electrode point in the radial direction of the spark plug. But here also the ground electrodes protrude beyond the front end of the insulator roughly by their thickness. In this way, a favorable formation for the electric field is attained, thus preventing ceramic breakdowns.

Furthermore, the platinum central electrode can be additionally coated, e.g., using boronization, aluminization, nitration, or siliconization. This coating enables the platinum electrodes to be sintered, gas-tight, in the ceramic. The soldered connection of the platinum central electrode, the insulator, and the contact pin also contributes to a gas-tight bond, thus preventing contact pin corrosion and retraction. Ultimately, the contact pin can also be replaced by an electrically conductive ceramic-metal coating.

What is claimed is:

1. A spark plug comprising:

a tube-shaped metal housing;

an insulator embedded in the housing;

a rod-shaped inner conductor arrangement disposed in the insulator, the inner conductor arrangement including a connection bolt, a current-limiting resistor being forward-positioned towards a spark gap, a coated contact pin, and a nail-shaped platinum central electrode having a first part and a second part, the first part being embedded in the insulator and having a smaller diameter than the second part, the second part protruding out of the insulator; and a plurality of ground electrodes being secured to the housing and being bent towards the central electrode, the plurality of ground electrodes protruding beyond an end face of the insulator, an amount of protrusion corresponding to a thickness of the central electrode.

2. The spark plug according to claim 1, wherein the plurality of ground electrodes have a first bend and a second bend, the first bend being in a direction of the insulator and the second bend being away from the insulator, so that an end face of the plurality of ground electrodes points away from the housing.

3. The spark plug according to claim 1, wherein the plurality of ground electrodes include four ground electrodes.

* * * * *